US005333853A

United States Patent [19]

Hektor

[11] Patent Number: 5,333,853

[45] Date of Patent: Aug. 2, 1994

[54] APPARATUS FOR RETURNING BASKETBALLS TO FREETHROW LINE

[76] Inventor: Otto L. Hektor, 205 E. Old Elm Rd., Lake Forest, Ill. 60045

[21] Appl. No.: 149,626

[22] Filed: Nov. 9, 1993

[51] Int. Cl.[5] ..... A63B 69/00

[52] U.S. Cl. ..... 273/1.5 A

[58] Field of Search ..... 273/1.5 A, 395-397

[56] References Cited

U.S. PATENT DOCUMENTS

| | | | |
|---|---|---|---|
| 1,765,269 | 6/1930 | Hatley | 273/1.5 A |
| 3,901,506 | 8/1975 | Caveney | 273/1.5 A |
| 4,697,810 | 10/1987 | Mathison | 273/1.5 A |
| 4,786,371 | 11/1988 | Postol | 273/1.5 A |
| 4,838,549 | 6/1989 | Woodall | 273/1.5 A |
| 4,896,882 | 1/1990 | Coleman | 273/1.5 A |
| 5,060,940 | 10/1991 | Mullen | 273/1.5 A |
| 5,129,648 | 7/1992 | Sweeney et al. | 273/1.5 A |
| 5,273,276 | 12/1993 | Warren | 273/1.5 A |

*Primary Examiner*—Paul E. Shapiro
*Attorney, Agent, or Firm*—Keil & Weinkauf

[57] ABSTRACT

Art apparatus for returning basketballs falling in front of the backboard to a shooter at the freethrow line. The apparatus may be mounted to the backboard, a free-standing post supporting the backboard, or to the hoop bracket. The apparatus contains a closed frame which bends down and away from the backboard. The closed frame supports a return surface such as webbing or sheeting. The apparatus may be easily attached for use, detached following use or swung into an out-of-the-way storage position.

9 Claims, 9 Drawing Sheets

FIG. 1b
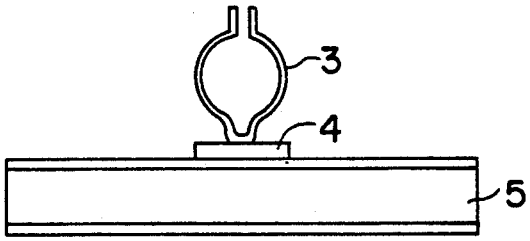
FIG. 1c
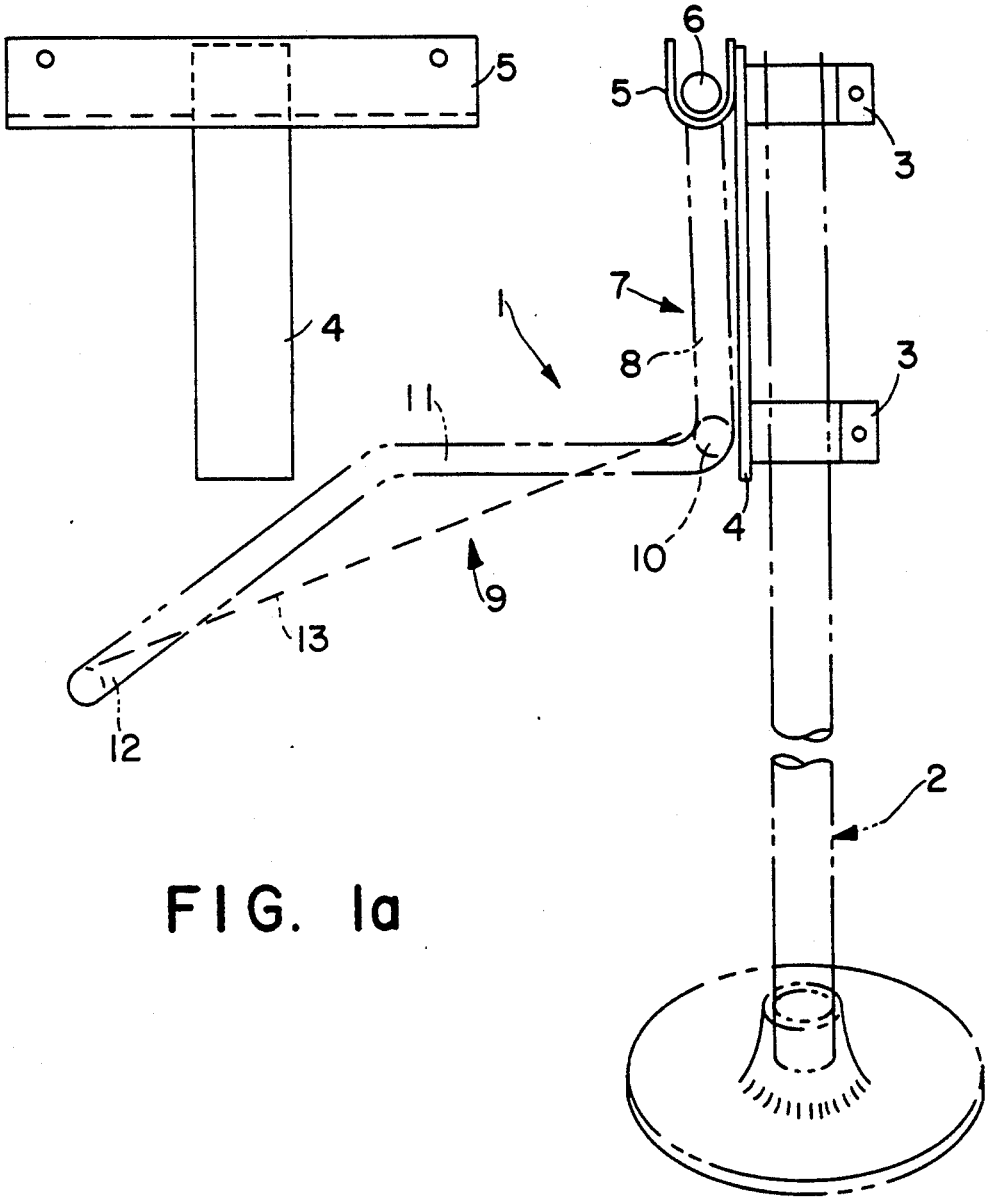
FIG. 1a

FIG. 2b
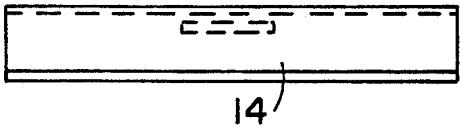
FIG. 2c
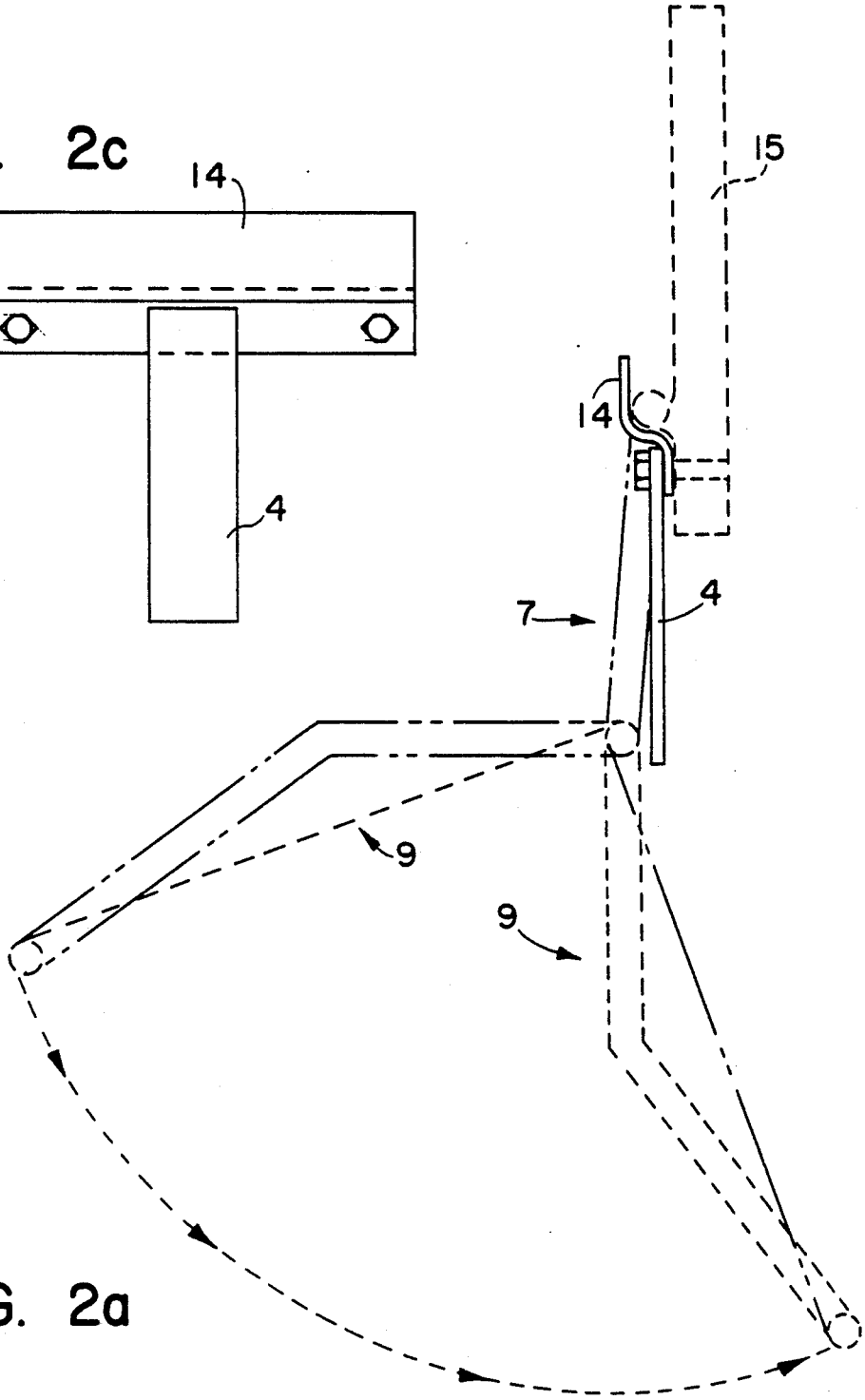
FIG. 2a

APPARATUS FOR RETURNING BASKETBALLS TO FREETHROW LINE

BACKGROUND OF THE INVENTION

1. Field of the Invention

This invention relates to an apparatus which returns sketballs from the vicinity of the backboard to the shooter at the freethrow line.

2. Description of the Related Art

Prior to the present invention, there has been a continuing need for a basket ball return apparatus which is easily mountable near a basketball hoop and adapted to return the ball to the freethrow line in a manner which simulates the throwing of the ball by the official. There has been an accompanying need that such apparatus not be cumbersome and be easily storable and/or retractable, yet light in weight and simple to handle.

Prior to the present invention, there have not been any such apparatus in existence. Existing typical prior art is evidenced by the following patents, for example. U.S. Pat. No. 1,765,269 to Hatley granted Jun. 17, 1930 discloses a frame of which upper ends are fixedly but detachably inserted into ring-loops extending from a lower edge of a backboard, with the lower end held by insertion into an extended base member lying on the ground; storage is possible solely by withdrawing the inserted upper ends and thereafter during storage folding at hinge-areas located at points positioned about half-way up the frame side-bars. U.S. Pat. No. 3,917,263 to Wiley granted Nov. 4, 1975 is a basket-like apparatus supported from the ground to be positioned beneath a basketball backboard basket such that a ball solely falling through the basket will be guided by railings forwardly to a shooting position. U.S. Pat. No. 3,901,506 to Caveney granted Aug. 26, 1986 discloses a basketball backboard having side deflectors with a net attached to the side deflectors and to the backboard, with the bottom of the net fastened forwardly to the floor by unspecified floor inserts. U.S. Pat. No. 4,291,885 to Cohen granted Sep. 29, 1991, somewhat similar to that of Cavehey patent, discloses a basketball backboard mounting apparatus that grasps the entire board and that suspends an upper end of a net from high points along the backboard, as well as from below the board, with the forward end having an attached strap for wrapping around a waist of a person, such as a bed-ridden person, such that the ball is returnable to that person lying in bed. U.S. Pat. No. 3,814,421 to Spier, Jr. granted Jun. 4, 1974 is to a basket attachment, such that when the basketball goes through the basket, it will be caused to fall forwardly toward the center of the basketball court directly in front of the basketball backboard. U.S. Pat. No. 4,786,371 to Postol granted Nov. 22, 1988 discloses a basketball return apparatus which contains netting and a frame. The frame is supported by legs. This apparatus returns the ball toward the freethrow line in such a manner that it becomes motionless at a level which is above the level of the court. Thus, this apparatus lacks the simulation of a ball thrown back by an official. Accordingly, it can readily be seen that the prior art does not solve all the problems addressed by the present invention.

SUMMARY OF THE INVENTION

In its broadest aspect, the present invention may be described as a basketball return apparatus which may be attached to the post, backboard or hoop bracket and comprises a mounting bracket which attaches to the post, backboard or hoop bracket, a hanging support which is held by the mounting bracket, and which, in turn, holds a closed frame which has side-to-side dimensions approximating that of the backboard.

The apparatus may have a pivot mechanism which allows the closed frame to assume an "in use" outward position or a "storage" downward position.

The apparatus has the advantage of returning basketballs to a player at the free throw line in a manner which simulates the return throw by an official.

The apparatus of this invention returns not only those balls which fall through the hoop, but also those balls which fall within the proximity of the hoop within the side-to-side dimension of the backboard.

The apparatus of this invention may be easily attached to, and detached from, basketball backboards, basketball hoop mounting brackets, or posts which hold the backboards.

BRIEF DESCRIPTION OF THE DRAWINGS

FIG. 1*a* shows an elevational side view of the basketball return apparatus attached to a free-standing post which may be placed directly under a permanently mounted basket ball hoop.

FIG. 1*b* shows details of a post clamp for connecting the apparatus to the post.

FIG. 1*c* shows details of the back plate which is held to the post by means of the post clamps and which supports a "U"-bracket.

FIG. 2*a* shows an elevational side view of two positions of the basketball return apparatus, in use and in storage. An embodiment is depicted showing the mounting of the support for the apparatus directly to the backboard.

FIG. 2*b* shows a top elevational view of an "S"-bracket which serves as a support for the basketball return apparatus.

FIG. 2*c* shows a front elevational view of the "S"-bracket and the back plate which serves to support the basketball return apparatus.

DESCRIPTION OF THE PREFERRED EMBODIMENTS

Figure 3A:
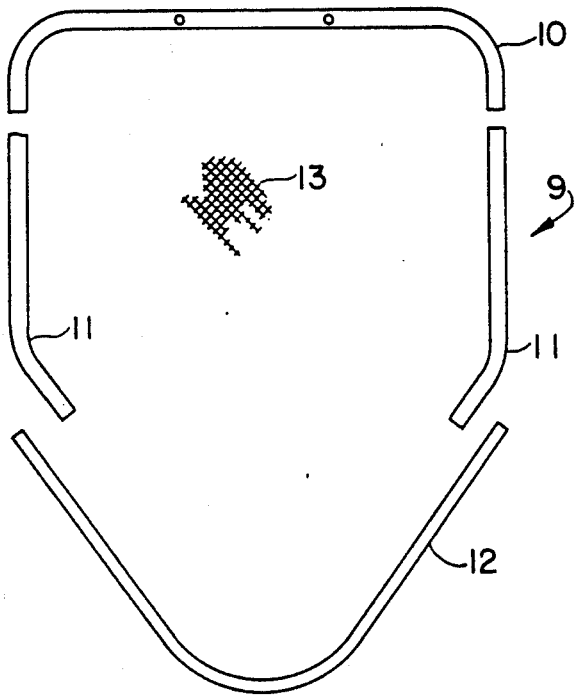
FIG. 3*a* shows an exploded elevational top view of the closed frame portion of the apparatus.

Referring to FIGS. 1a, 1b and 1c, the basketball return apparatus 1 is attached to a free-standing post below the backboard (not shown). A pair of post clamps 3 hold a back plate 4 to the post 2. A "U"-shaped bracket 5 is fixedly attached to the back plate 4. The "U"-shaped bracket 5 holds the upper member 6 of the main hanging brace 7. Side members 8 of the main hanging brace 7 extend vertically downward from the upper member 6. The closed frame 9 is detachably attached to the lower ends of the side members 8. The closed frame 9 is made up of a proximal member 10, two side members 10 and a rounded "V"-shaped distal member 12. The side-to-side measurement of the closed frame 9 is approximately the same as the width of the backboard (not shown). The side member 11, proceeding from the proximal member 10 to the distal member 12, contains a downward angle. The closed frame 9 supports a return surface 13, which is a single continuous member having a central axis and being connected on all sides to the closed frame 9. When in the operating position, as shown in FIG. 1a, the return surface slopes downwardly from the sides to its central axis and slopes downwardly from its proximal end to its distal end under the weight of a basketball. The arrangement allows a basketball falling onto the return surface 13 to be returned to the shooter at the freethrow line in a manner approximating that of a ball returned by an official. The return surface 13 may conveniently be made of cloth or plastic sheeting or rope or plastic webbing.

Referring to FIGS. 2a, 2b and 2c, an "S"-bracket 14 is held to the backboard 15 by an attachment means such as a bolt or a screw passing through the back plate 4, the "S"-bracket 14 and into or through the backboard 15. The "S"-bracket 14 in conjunction with the backboard 15, forms a "U"-shaped slot.

The upper member 6 of the main hanging brace 7 fits into and is held securely by the "U"-shaped slot.

FIG. 2a depicts the closed frame 9 in the outward operating position and in the downward flip-out-of-the-way position.

Figure 3B:
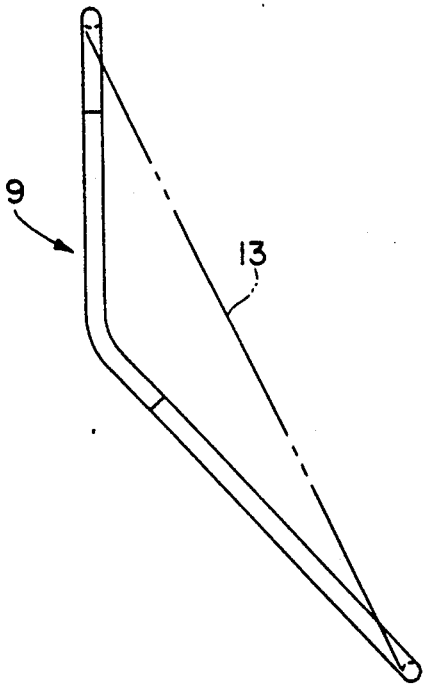
FIG. 3*b* shows an elevational side view of the closed frame with the return surface in place.

Referring to FIGS. 3a and 3b, the closed frame 9 and the return surface 13 are seen in greater detail.

In FIG. 3a, the closed frame 9 is depicted in an embodiment wherein it is made of separate members, i.e., proximal member 10, side members 11 and distal member 12. When the closed frame 9 is made of several members, these members may be tubes which insert one into the other, the side pieces 11 being slightly larger in diameter than the proximal 10 and distal 12 ends and slide over these end pieces. Alternatively, the closed frame 9 may be a single continuous member. In either case, the closed frame may be made of metal or plastic.

Figure 4A:
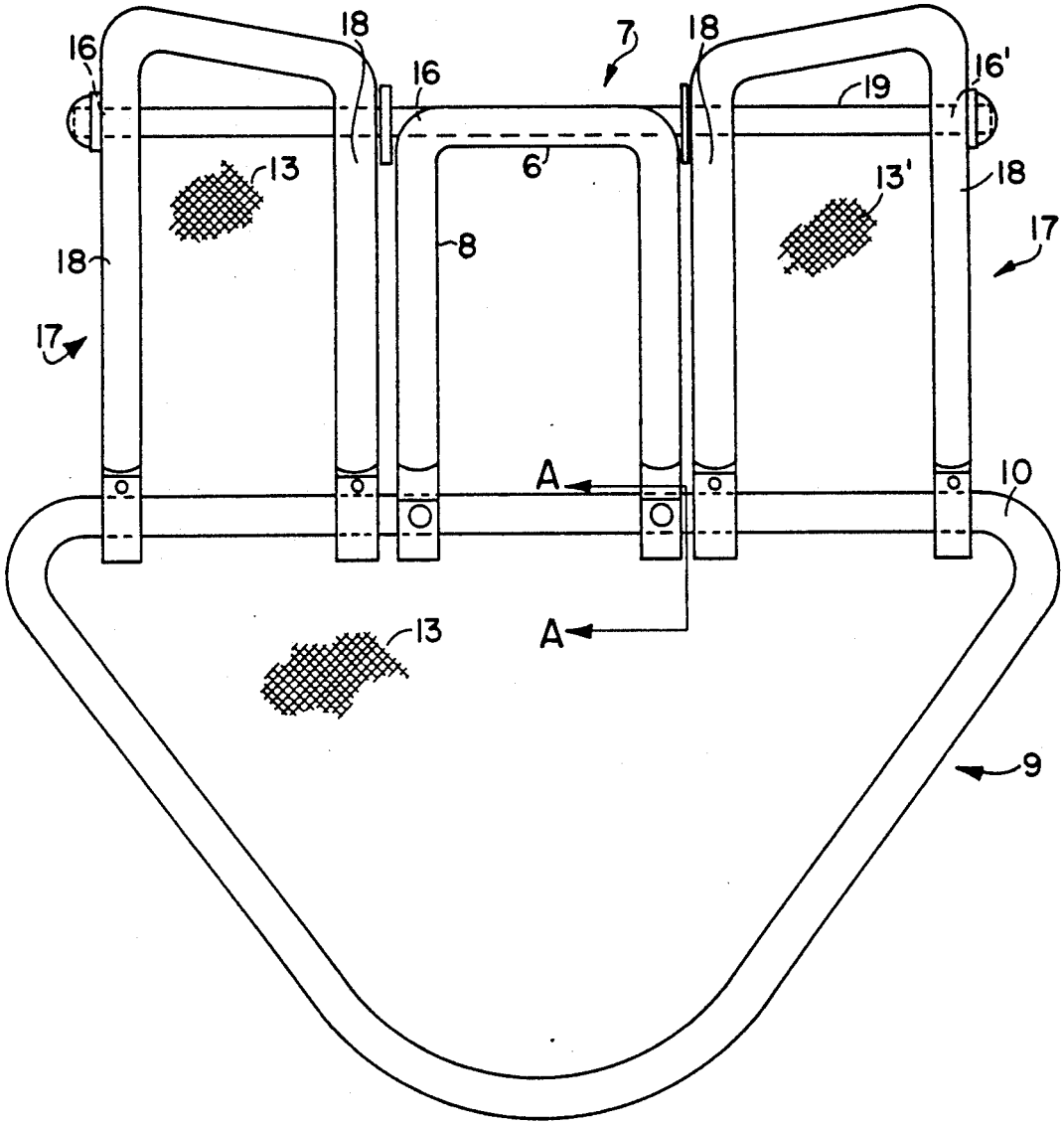
FIG. 4*a* shows an elevation front view of an alternate embodiment of the invention which contains two backstops.
Figure 4B:
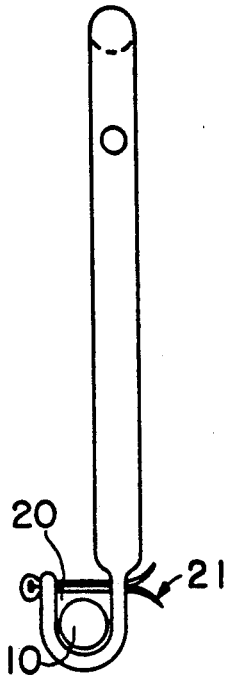
FIG. 4*b* shows a side elevational view of a backstop, illustrating how the closed frame is mounted in the "U"-shaped bottom of the backstop.
Figure 4C:
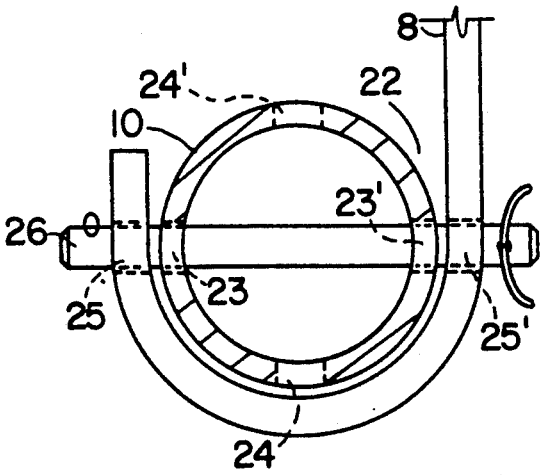
FIG. 4*c* is a cross-sectional side view of the bottom of the main hanging brace showing how the closed frame is mounted for use and how it can be mounted in the storage "flip-out-of-the-way" position.
Figure 5:
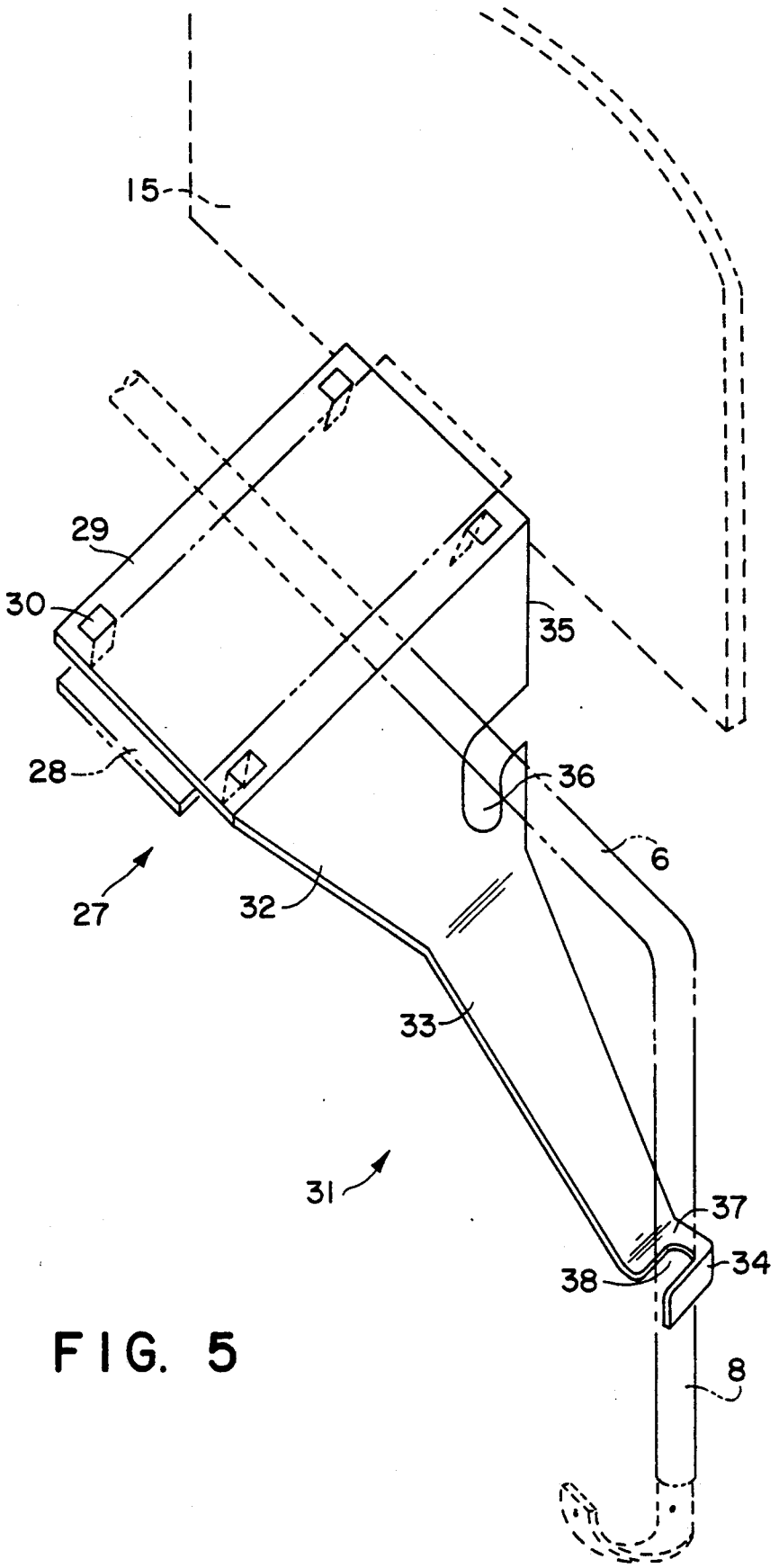
FIG. 5 shows an elevational perspective view showing how the main mounting bracket straddles the hoop mounting bracket and how the main hanging brace for the basketball return apparatus fits into the locking slots both on the horizontal and vertical segment of the leg members of the main mounting bracket.
Figure 6A:
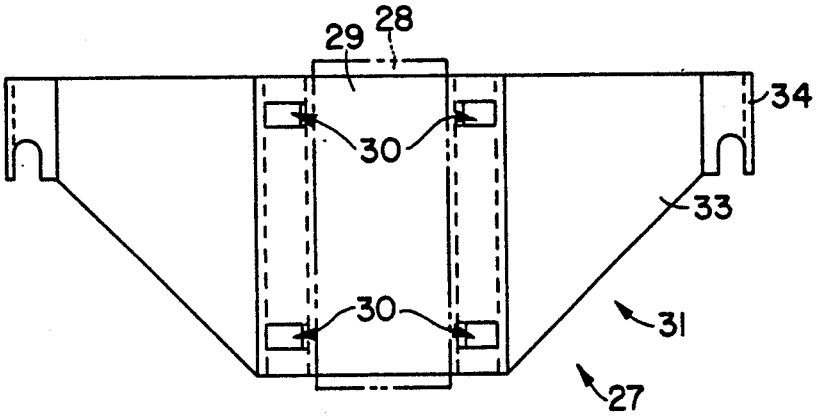
FIG. 6*a* shows an elevational top view of the main mounting bracket for the basketball return apparatus.
Figure 6B:
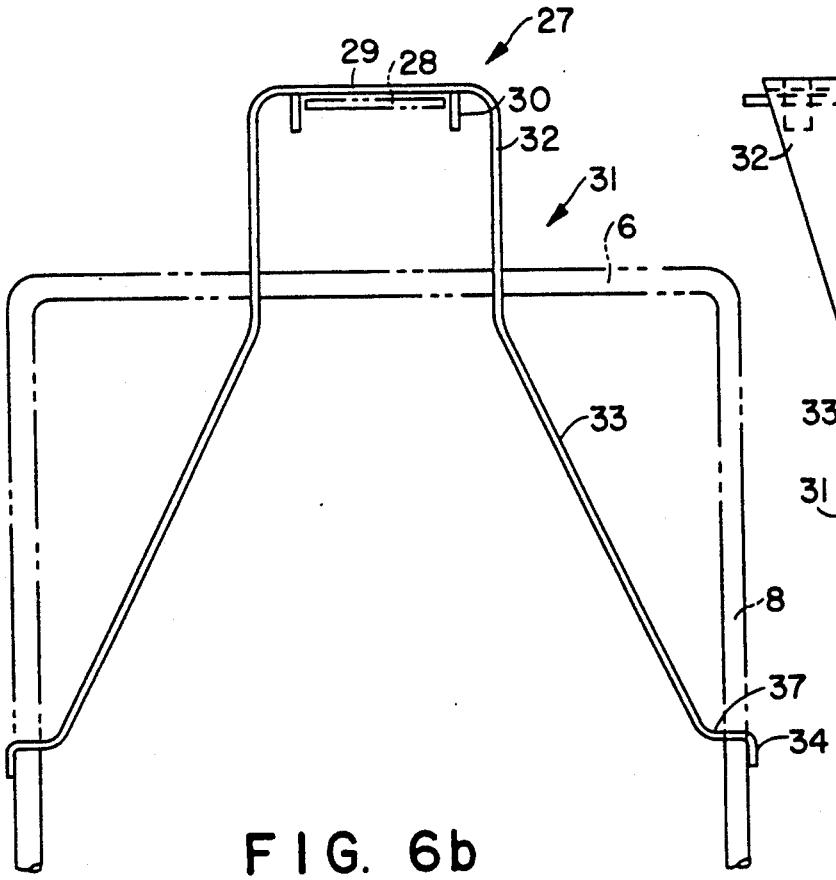
FIG. 6*b* shows an elevational front view of the main mounting bracket and its relation to the main brace of the basketball return apparatus.
Figure 6C:
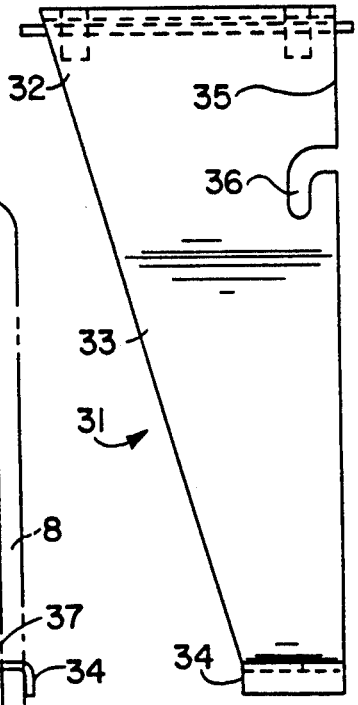
FIG. 6c shows an elevational side view of the main mounting bracket for the basketball return apparatus.

Referring to FIGS. 4a, 4b and 4c, an alternate design is shown and the attachment of the main hanging brace 7 to the proximal member 10 of the closed frame 9 is more clearly depicted.

In FIG. 4a, main hanging brace 7 has an opening 16 on either side of the upper member 6 thereof. The main hanging brace 7 has a backstop 17 on either side. Each side member 18 of each backstop 17 has an opening 16' therein. A rod 19 is passed through each opening 16 16' to secure the main hanging brace 7 to each backstop 17. Each backstop 17 supports a return surface 13', which aids in directing deflected basketballs to the return surface 13 of the closed frame 9.

FIG. 4b depicts the manner in which the backstops 17 are attached to the proximal member 10 of the closed frame 9. Each side 18 of each backstop 17 has a "J"-shaped slot 20 at its lower end. The proximal member 10 of the closed frame 9 rests in this "J"-shaped slot. A locking device 21, such as a cotter pin, secures the proximal member 10 in the slot 20. With this arrangement, proximal member 10 may turn freely and change the closed frame 9 from an outward operating position to a downward out-of-the-way position.

FIG. 4c depicts the manner in which the main hanging brace 7 supports the closed frame 9. The lower ends of the side members 8' of the main hanging brace 7 end in "J"-shaped slots 22. The proximal member 10 of the closed frame 9 rests in this "J"-shaped slot 22. The proximal member 10 has openings 23 23' 24 24' which align with openings 25 25' in the side members 8 of the main hanging brace 7. When secured with a locking device 26, such as a locking pin, this arrangement of openings allows the closed frame 9 to be securely held in either the outward operating position or the downward stored position. Changing from one position to the other can be done quickly and easily.

FIGS. 5, 6a, 6b, 6c, 7a, 7b and 7c depict alternate methods of mounting the basketball return apparatus. In each of the Figures, a mounting bracket 27 is mounted on the hoop bracket 28, which is attached to the backboard 15.

The mounting bracket 27 has a top member 29 mounted to the hoop bracket 28 by locating tabs 30.

Descending from each side of the top member 29 is a leg member 31. Each leg member 31 is made up of an upper vertical segment 32, an outwardly and downwardly sloping middle segment 33, and a lower segment 34.

The upper vertical segment 32 has a proximal aspect 35 having a locking notch 36 therein. The upper member 6 of the main hanging brace 7 slidingly fits into and is secured by this locking notch 36.

The outwardly and downwardly sloping middle segment 33 connects the upper vertical segment 32 to the bottom segment 34.

The bottom segment 34 has a horizontal plane 37 containing a "U"-shaped opening 38. The two side members 8 of the main hanging brace 7 are held securely in place by the two "U"-shaped openings 38 of the bottom segment 34.

FIGS. 5, 6a, 6b and 6c depict the mounting bracket 27 as being constructed of sheet material, such as metal or plastic.

Figure 7A:
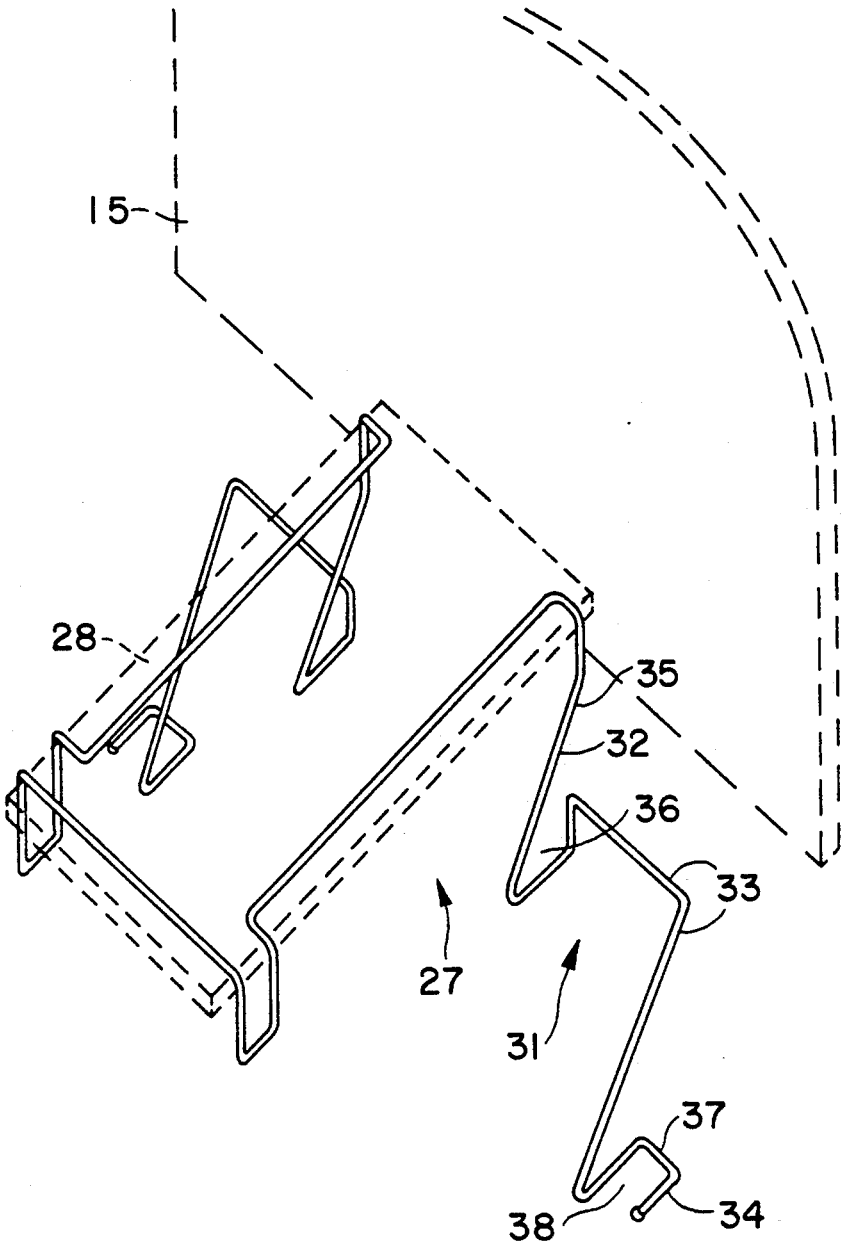
FIG. 7a shows an elevational perspective view of a main mounting bracket in wire form mounted on the hoop mounting bracket.
Figure 7B:
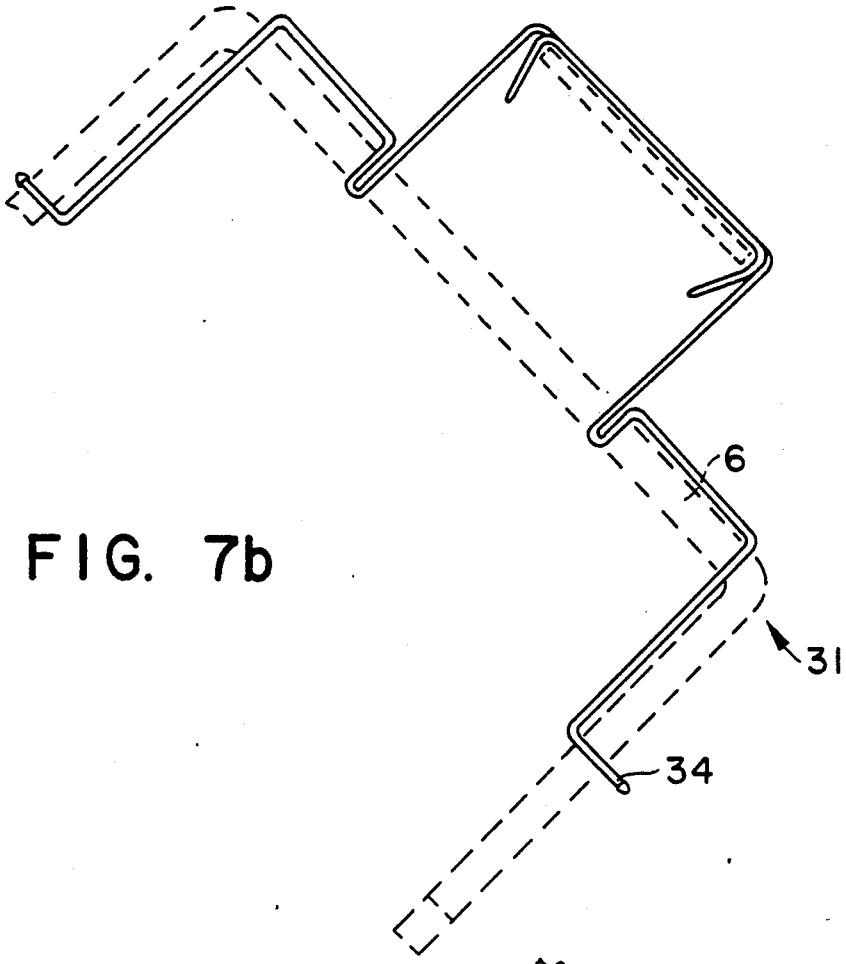
FIG. 7b shows an elevational perspective view of the wire form of the main mounting bracket and its relationship with the main hanging brace for the basketball return apparatus.
Figure 7C:
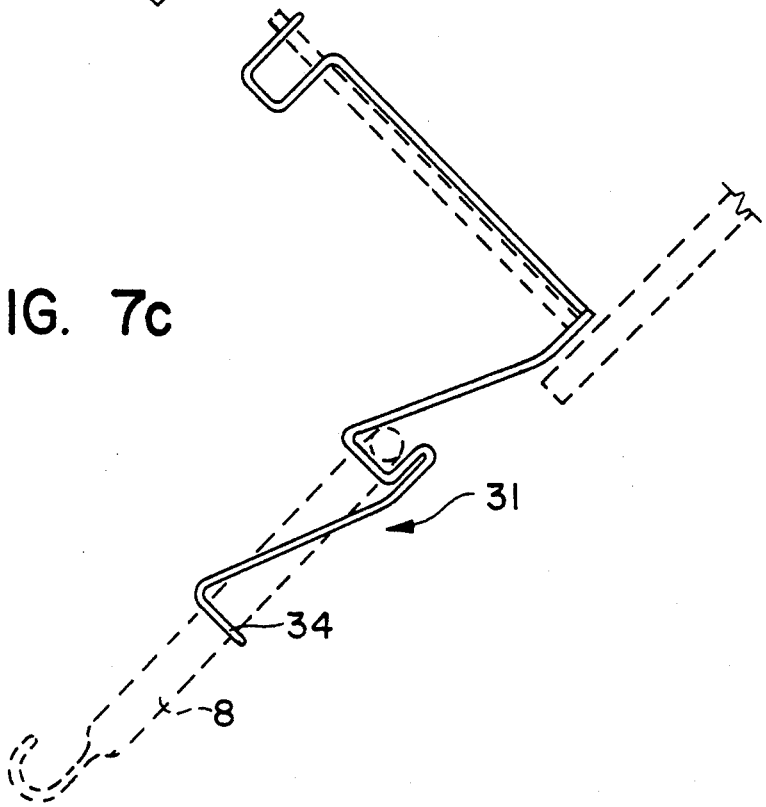
FIG. 7c is an elevational side view of the wire form of the main mounting bracket showing its relationship to the backboard, hoop mounting bracket and main hanging brace for the basketball return apparatus.

FIGS. 7a, 7b and 7c depict the mounting bracket as being constructed of wire material, such as metal or plastic.

In these arrangements, the main hanging brace 7 may be quickly and easily mounted and removed and is securely held in place when mounted.

I claim:

1. An apparatus for returning basketballs from a position under or adjacent to a basketball hoop having a hoop bracket and mounted on a backboard in a direction toward a corresponding freethrow line, which apparatus comprises (1) a closed frame comprising a proximal member, two side members and a distal member; (2) a return surface; and (3) a main hang brace; the proximal member having a side-to-side dimension which is about the same as the side-to-side dimension of the backboard; the side members, proceeding from the proximal member to the distal member, contain an angle in a downward direction; the distal member having the shape of a rounded "V"; the return surface being a single continuous member having a central axis and being connected on all sides to the closed frame so that, when in the operating position, the return surface slopes downwardly from the sides to the central axis and slopes downwardly from the proximal end to the distal end under the weight of the basketball; and the main hanging frame comprises an upper member and two side members, the upper member being above and parallel to the proximal member of the closed frame; the two side members having upper and lower ends, the lower ends being "J"-shaped and capable of holding the proximal member of the closed frame, the lower ends of the side members of the hanging frame and the proximal member of the closed frame being provided with openings which are aligned to provide access by a locking device.

2. The apparatus of claim 1, wherein the proximal member of the closed frame is provided with a double set of openings so arranged as to allow securing of the closed frame in an outward position allowing for the return of basketballs and a downward position for storage.

3. The apparatus of claim 1, wherein a rod is extended through the upper member of the main hanging brace in a direction parallel to the proximal member of the closed frame, a backstop is mounted on the rod on each side of the main hanging frame, each backstop containing an upper member and two side members, the upper member being above the proximal member of the closed frame, the two side members having upper and lower ends, the lower ends being "J"-shaped and capable of holding the proximal member of the closed frame, the lower ends of side members of the backstops being provided with aligned openings to provide access by a locking device for securing the proximal member of the closed frame, each backstop being provided with a return surface for directing basketballs toward the return surface of the closed frame.

4. The apparatus of claim 1, wherein the backboard is mounted on a free-standing post, a backplate is mounted to the post below the backboard, a "U"-bracket is mounted on the backplate, and the upper member of the main hanging frame rests in the "U"-bracket.

5. The apparatus of claim 1, wherein a backplate and an "S"-bracket are mounted on the backboard in such a manner that a "U-shaped slot is formed between the backboard and the "S"-bracket, and the upper member of the main hanging frame rests in the "U"-shaped slot.

6. The apparatus of claim 1, wherein a hanging bracket is mounted on the hoop bracket, which hanging bracket has a top member which rests upon the hoop bracket and two leg members each of the leg members containing an upper vertical segment which has a proximal aspect having a locking notch therein, an outwardly and downwardly sloping middle segment and a lower segment which has a horizontal plane containing a "U"-shaped opening, the upper member of the main hanging frame resting in the locking notches and the two side members of the main hanging brace being held by the two "U"-shaped openings of the bottom segments of the legs.

7. The apparatus of claim 6, wherein the hanging bracket is made of sheet material.

8. The apparatus of claim 6, wherein the hanging bracket is in the form of a wire.

9. The apparatus of claim 1, wherein the return surface is made of rope webbing, cloth sheeting or plastic sheeting.

* * * * *